US006694855B1

(12) United States Patent
Emmerich et al.

(10) Patent No.: US 6,694,855 B1
(45) Date of Patent: Feb. 24, 2004

(54) DEVICE FOR CONTROLLING THE THREAD LEVER OF A BRAIDER AND A BRAIDER

(76) Inventors: Wolfgang Emmerich, Braamer Str. 99, Hamm 59071 (DE); Rainer Dorstewitz, Kalkgasse 15, Bensheim 64625 (DE)

( * ) Notice: Subject to any disclaimer, the term of this patent is extended or adjusted under 35 U.S.C. 154(b) by 0 days.

(21) Appl. No.: 10/203,066

(22) PCT Filed: Jan. 27, 2000

(86) PCT No.: PCT/EP00/00615

§ 371 (c)(1),
(2), (4) Date: Jul. 26, 2002

(87) PCT Pub. No.: WO01/55493

PCT Pub. Date: Aug. 2, 2001

(51) Int. Cl.[7] ..... D04C 3/40; D04C 3/42
(52) U.S. Cl. ..... 87/44; 87/48
(58) Field of Search ..... 87/31, 33, 34, 87/44, 48, 62; 66/1 R, 3, 9 A; 139/457

(56) References Cited

U.S. PATENT DOCUMENTS 2,672,071 A * 3/1954 Marogg ..... 87/46
4,620,473 A * 11/1986 Bull ..... 87/48
5,787,784 A * 8/1998 Scherzinger ..... 87/44
5,931,077 A * 8/1999 DeYoung ..... 87/44

* cited by examiner

*Primary Examiner*—John J. Calvert
*Assistant Examiner*—Shaun R Hurley
(74) *Attorney, Agent, or Firm*—Gudrun E. Huckett

(57) ABSTRACT

The present invention relates to a braider (1) comprising a device for controlling the thread lever (10). Said braider is formed by a curved path (30) that is closed in a circular ring-shaped manner, a sliding block (31) appurtenant thereto and a reverse gear (20) by means of which the direction of rotation of the drive motor is reversed in such a way that the group of the upper delivery bobbins and the group of the lower delivery bobbins rotate in opposing directions. The aim of the invention is to enable such a braider (1) to have a higher ceiling speed. The sliding block (31) and the curved path (30) are situated within the surface (32) of rotation, whereby said surface is circumscribed by the course of the thread lever (10) around a central axis (50) in relation to the braider (1), and/or the reverse gear (20) is provided with an internal ring gear which is fixed to the central pipe (3) and has a great reference diameter, a pinion circulating therein and an outer ring gear that is rotatably mounted on the central pipe (3) and has a small reference diameter. The pinion is rotatably mounted on a circulating axle which is rigidly connected to the housing. Said pinion causes the positive fit between the internal ring gear and the outer ring gear.

13 Claims, 5 Drawing Sheets

DEVICE FOR CONTROLLING THE THREAD LEVER OF A BRAIDER AND A BRAIDER

BACKGROUND OF THE INVENTION

1. Field of the Invention

The present invention relates to a device for controlling the thread lever of a braiding machine comprised of the combination of a circular ring-shaped, closed curved path and correlated sliding block, wherein the thread lever has a pivot axle which is connected above the lower feed bobbins to the gear housing, which is rotatingly driven in a first rotational direction about the central pipe of the braiding machine, wherein the thread lever describes as a result of the rotational movement of the gear housing a rotational plane and, by means of the sliding block, is imparted with an oscillating pivot movement about its pivot axle in this rotational plane, and wherein the rotational movement of the gear housing is transformed into a second rotational direction opposite to the first rotational direction via a reversing gear with intermediate wheel and is then imparted onto the bobbin carriers of the warp thread bobbins. The present invention further relates to a braiding machine with a central pipe and a housing rotatingly driven about the central pipe in a first rotational direction, on which bobbin carriers for the lower feed bobbins are seated as well as with upper bobbin carriers for the upper feed bobbins which are also rotatably supported to rotate about the central pipe, wherein between the lower feed bobbins and the upper feed bobbins a positive-locking reversing gear with intermediate wheel is provided which at the input side is loaded by the rotational direction of the housing and at the output side generates the second rotational direction opposite to the first rotational direction with which the upper bobbin carriers of the upper feed bobbins are loaded.

2. Description of the Related Art

Such braiding machines are known; see, for example, the catalog of Spirka "Spirka-Schnellflechter". These rapid braiders, according to the catalog, allow rotational speeds up to approximately 150 per minute, depending on the number of bobbin groups rotating in opposite directions, respectively.

The plurality of required gear couplings and kinematic parameters make it difficult to increase this rotational speed at will.

One of the decisive parameters of a braiding machine is the rotational speed limit. It depends on several factors, i.e., the type of control of the thread lever and/or the type of gear coupling between the drive members, the reversing gear, and the bobbin carriers.

The thread lever, on the one hand, must be pivotably supported above the weft thread bobbins, and, on the other hand, below the warp thread bobbins.

In this connection, the upper end of the thread lever must project past the warp thread bobbins to such an extent that the corresponding weft thread can be received by a thread guide which defines the movement plane of the weft thread above the warp thread.

Conventionally, the control of the thread lever results from a combination of a circular ring-shaped, closed curved path with corresponding sliding block. The curved path is arranged outside of the rotation plane on which the thread lever circulates during rotation of the weft thread bobbins.

The curved path thus encompasses the entire braiding machine.

However, since the thread lever has a relatively great length, relatively high moments of inertia are to be expected which must be exerted as forces by the sliding path pair—comprised of the sliding block and the curved path—in order to impart onto the thread lever its fast pivot movement. The relatively large spacing of the curved path from the center of rotation moreover effects relatively high relative speeds between the sliding block and the curved path so that relatively high surface pressures are to be expected in this connection.

On the other hand, the reversing gear of braiding machines with central pipes is an important component in order to impart onto the upper bobbin carriers a rotational movement about the central pipe opposite to that of the lower bobbin carriers.

Since these mechanical gears contribute significantly to the power requirements of a braiding machine, there is always the tendency to use gears with minimal consumption of power.

However, this causes the problem that, in addition to a reversal of the rotational direction between lower thread bobbins and upper thread bobbins, also a predetermined ratio of transmission must be maintained which is prescribed by the braiding process.

It is therefore the object of the present invention to improve the braiding machine such that higher rotational speeds are enabled.

SUMMARY OF THE INVENTION

On the one hand, this object is solved by the invention in regard to the device for controlling the thread lever in that the sliding block and the curved path are located within the rotational plane, and, on the other hand, in regard to the braiding machine in that the reversing gear comprises an internal ring gear stationarily arranged on the central pipe with a large reference diameter, a pinion revolving therein, and an external ring gear with small reference diameter rotatably supported on the central pipe, and wherein the revolving pinion is rotatably supported on a revolving axle fixedly connected with the housing as well as provides the positive-locking connection between the internal ring gear and the external ring gear.

There are therefore two different measures with which the rotational speed limit of such braiding machines can be increased.

These measures can be realized independently from one another and also in combination with one another on a single braiding machine.

In the following, the inventive measures of the device for controlling the thread lever will be discussed first.

This part of the invention results in the advantage that for a more compact configuration of the braiding machine the weft thread bobbins and the warp thread bobbins become more easily accessible.

This advantage is achieved in that the previously known enclosure of the braiding machine by the stationary curved path is eliminated and replaced with an inwardly displaced curved path; this facilitates access to the weft thread bobbins and the warp thread bobbins.

An important factor of this part of the invention is that the sliding block and the curved path are positioned within the rotational plane which is described by the thread lever upon its rotation about the central pipe of the braiding machine.

On this rotational plane the thread lever additionally carries out the pivot movement which results in the braiding of the warp threads and the weft threads.

With this part of the invention, on the one hand, the relative speed between the sliding block and the curved path is reduced, because the engagement circle between the sliding block and the curved path is on a smaller radius in comparison to a curved path arranged outside of the rotational circle.

Since the law of movement of the thread lever, moreover, is defined by the curvature of the so-called thread guide, the exact geometric shape of the curved path results automatically so that the weft thread traverses up and down with constant contact on the thread guide.

The more the engagement circle between the curved path and the sliding block is moved toward the central axis of the braiding machine, the smaller the relative speeds, without the predetermined law of movement of the thread lever being negatively affected. In this respect, it is desirable to position the engagement circle between the sliding block and the curved path within the circle which is described by the inner end of the pivot axle. This provides the additional possibility of positioning the pivot axle of the thread lever in a bore of the gear housing where the sliding block and the curved path can be positioned in an oil bath.

With the permanent oil lubrication enabled in this way, relative speeds between the sliding block and the curved path which have been unattainable previously should be permissible.

For simplifying the configuration, the curved path can be arranged on an annular console which is connected as a separate component stationarily to the central pipe.

Moreover, the pivot axle can be positioned at a slant such that it is inclined with its end facing the central pipe toward the braiding point. This practically means the exit end of the material to receive the braid from the central pipe. This enables an effective pivot movement above the warp thread bobbins and below the warp thread bobbins with minimal forces. The decisive limit angle—measured relative to the normal plane of the central axis—is 45 degrees. This results in a permissible angle range of 45°>alpha>0°.

When the curved path is then inclined additionally about an angle L like the pivot axle, an excellent surface contact between the sliding block and the curved path results.

In order to compensate moreover tension fluctuations which result upon pivoting of the thread lever, a thread buffer roll is additionally provided which serves for a temporary thread deposition of the weft thread upon pivoting in the sense that the weft thread tension is practically maintained constant.

From the additional dependent claims advantageous embodiments of the invention result. The second part of the invention has the advantage that the housing for receiving the gear of the braiding machine can be configured significantly smaller and more compact so that in this way also an excellent accessibility to the weft thread bobbins and the warp thread bobbins is ensured.

With the compact configuration of the housing, the resonance behavior of the braiding machine is favorably affected, and the rotational speed limit can thus be increased. In principle, this part of the invention is based on the reversing effect which is caused by the pinion revolving within the internal ring gear. The internal ring gear is stationary; the pinion circulating in its interior is supported at its engagement location with the external ring gear with smaller reference diameter on the output side of the gear, and the reversal of the rotational direction is caused in this way.

At the same time, this planet wheel arrangement enables the adjustment of the required rotational speed ratios which are required for the braiding process.

However, the special advantage of this part of the invention resides also particularly in its independence from the measures in regard to the device for controlling the thread lever.

Even though, this part of the invention can be used in combination with the features of the device for controlling the thread lever.

BRIEF DESCRIPTION OF THE DRAWINGS

In the following, the invention will be explained with the aid of embodiments in more detail. It is shown in.

DESCRIPTION OF PREFERRED EMBODIMENTS

Figure 1:
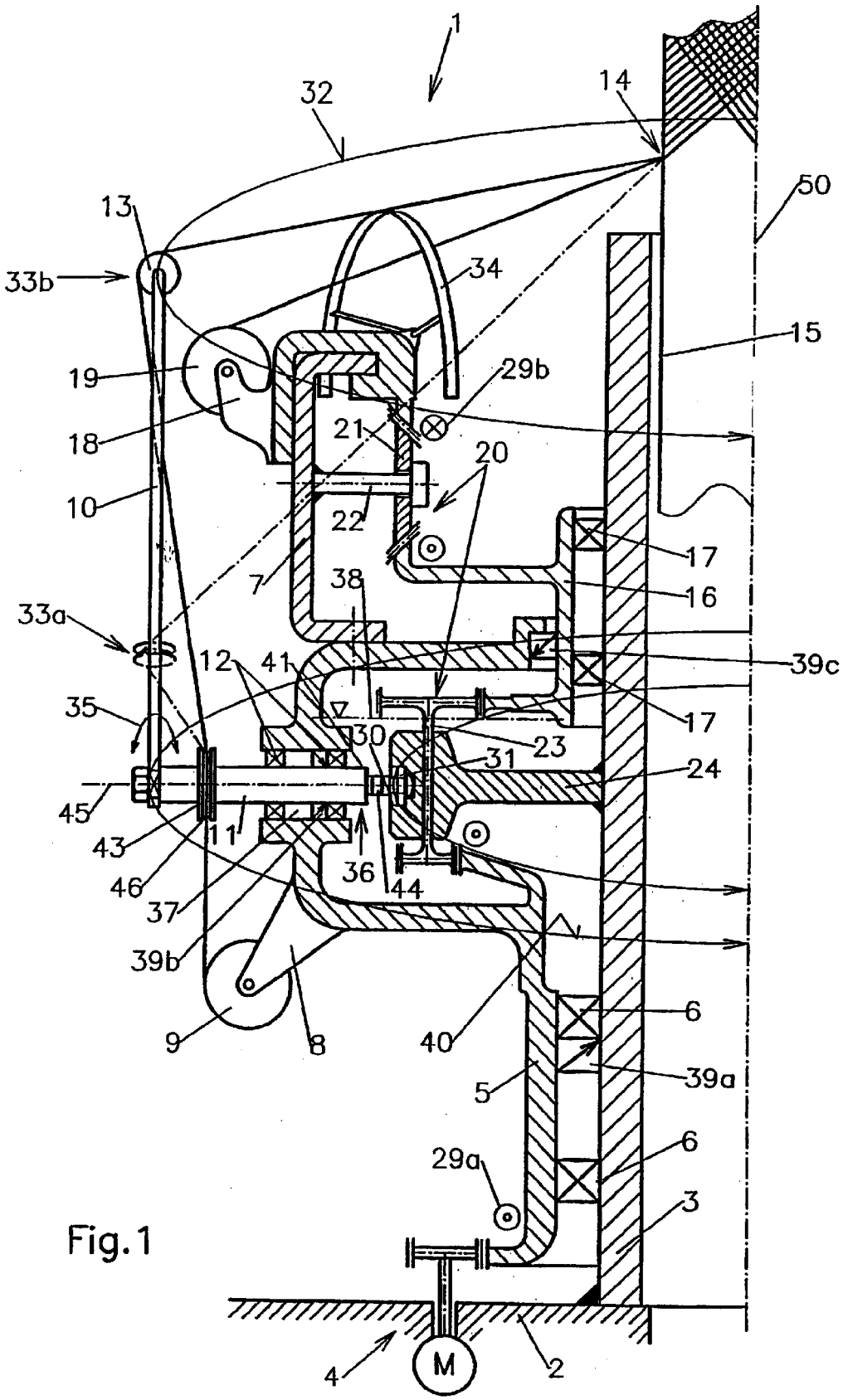
FIG. 1 a first embodiment of the invention.

If not indicated differently, the following description applies to all Figures.

The Figures show a braiding machine 1 in a schematic view.

A central pipe 3 is mounted rigidly on a machine frame 2.

The central pipe 3 serves in its lower area for receiving a gear housing 5 which is arranged by means of a gear housing bearing 6 rotatably on the central pipe 3.

By means of the drive 4 a rotational movement is imparted on the gear housing 5, and the rotation is carried out also by the sliding path carrier 7 connected to the gear housing 5.

In the lower area of the gear housing 5, lower bobbin carriers 8 are arranged which support a weft thread bobbin 9, respectively.

The weft thread is guided through a penetration, not illustrated in detail, in the thread lever 10 and extends from there to a deflection device 13 which is positioned on the upper end of the thread lever 10.

The thread lever 10 can be pivoted about a pivot axle 11 which is movable in a pivot axle bearing 12.

From the deflection device 13, the weft thread runs toward the braiding point 14 which can be found on the outer circumference of the elongate article 15 to receive the braid.

While the elongate article 15 is transported only in the vertically upward direction, the weft thread bobbins carry out a rotational movement in a predetermined rotational direction about the central pipe 3. This rotational movement is predetermined by the drive 4.

It can now be envisioned that the thread lever 10 when rotating about the central axis 50 describes a rotational plane which is concentric to the central axis 50. At the same time, the thread lever 10 carries out a pivot movement about its pivot axle 11. The pivot axle 11 is positioned above the lower feed bobbins—the weft thread bobbins 9—and is connected to the gear housing 5 such that the rotational movements of thread lever 10 and the gear housing 5 are synchronized.

Accordingly, the thread lever 10 and the gear housing 5 rotate in a first rotational direction about the central pipe 3 of the braiding machine.

At the same time, the thread lever 10 is automatically controlled by the positive-locking engagement between a sliding block 31 and a correlated curved path 30 such that it carries out an oscillating pivot movement 35 about its pivot axle 11 on the rotational plane 32 on which it rotates about the central axis 50. This pivot movement is caused by the course of the curved path 30 with which it is provided on its closed path about the central axis 50.

The positive-locking engagement between the sliding block 31 and the curved path 30 imparts therefore by means of a corresponding moment a movement onto the pivot axle which, depending on the configuration, is transmitted directly or indirectly onto the thread lever 10. In order to generate with this arrangement a braid, it is required to rotate the warp thread bobbins 9 in a second rotational direction 29*b* opposite to the first rotational direction 29*a*.

For this purpose, a reversing gear 20 is provided which is comprised of a transmission stage 23 and an intermediate wheel 21.

The reversing gear has the purpose to transform the rotational movement of the gear housing 5 into a rotational direction which is opposite to the first rotational direction and to then impart this rotation onto the warp thread carriers 18 which each support a warp thread bobbin 19. The warp thread carriers 18 move thus in a rotational direction opposite to the first rotational direction 29*a* about the central axis 50 and are guided when doing so on the sliding path carriers 7 which are provided only in segments like the warp thread carriers 18.

In this way, an alternating immersion and retraction movement results in the area of the sliding path carrier 7 and the warp thread carriers 18 in that the sliding path carrier 7 and the warp thread carriers 18 rotate in opposite directions to one another about the central axis 50.

For this purpose, the reversing gear 20 is provided which comprises the intermediate wheel 21 as an important component.

The intermediate wheel 21 is connected by means of the intermediate gear shaft 22 rigidly with the sliding path carrier 7. It is a bevel wheel which engages, on the one hand, the warp thread carrier 18 and, on the other hand, the internal ring gear 16 positive-lockingly. The internal ring gear 16 is independent of the gear housing and also rotatably supported on the central pipe 3. The bearing for this internal ring gear thus enables rotation of the internal ring gear 16 about the central pipe 3 independent of the gear housing 5.

Figure 2:
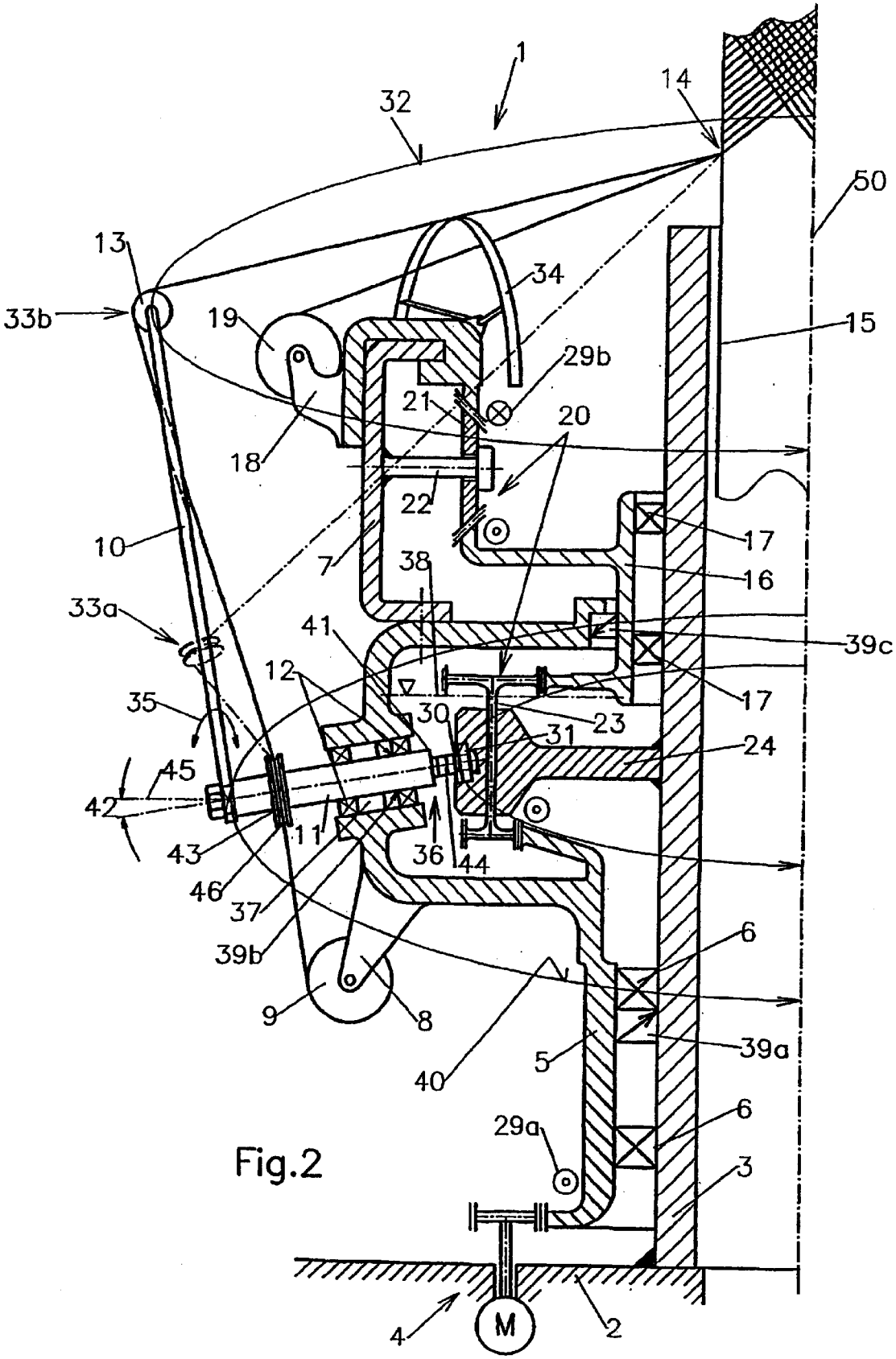
FIG. 2 an embodiment of the invention with slanted pivot axle.
Figure 3:
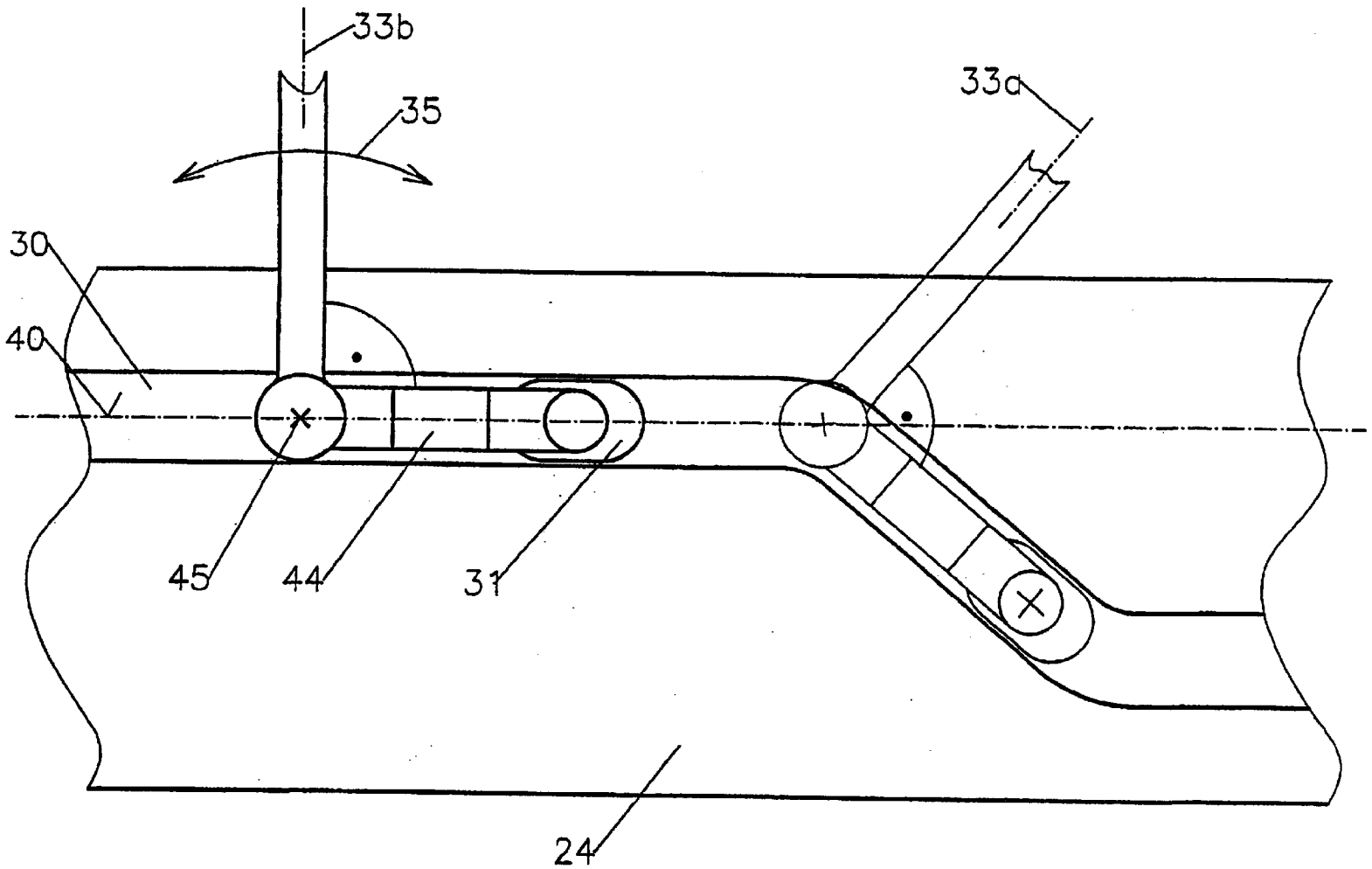
FIG. 3 a schematic illustration of the inner curved path with engaged sliding block.

Moreover, since the gear housing 5 and the internal ring gear 16 must have different rotational speeds, according to FIGS. 1 through 3 a transmission stage 23 is provided which is supported on an annular console 24.

The annular console 24 is fixedly connected on the central pipe 3.

The transmission stage 23 will be explained again in connection with a deviating embodiment with the aid of FIGS. 4 and 5.

In this embodiment, the transmission stage 23 is comprised of an internal ring gear 25 which is fixedly connected to the stationary annular console 24.

The internal ring gear has the greatest reference diameter within the transmission stage 23.

A pinion 26 revolves within the internal ring gear 25 and is rotatably supported on a revolving axle 28.

The revolving axle 28 is fixedly connected with the gear housing 5.

While the revolving pinion 26, on the one hand, is in engagement with the internal ring gear 25, the internal ring gear 16 has an external ring gear 27 with a small reference diameter with which the revolving pinion 26 also meshes.

The pinion 26 is thus constantly in engagement with the internal ring gear 25 having a large reference diameter as well as with the external ring gear 27 having a small reference diameter and rotates thus together with the gear housing 5 about the central axis 50 and on its revolving axle 28 because it is forced to do so by engagement of its toothing on the rigid internal ring gear 25.

Therefore, the rotational movements of the internal ring gear 16 and of the gear housing 5 are oriented in the same direction. However, the rotational movement is reversed by the intermediate wheel 21 so that the warp thread carrier 18 is rotated in a rotational direction opposite to that of the sliding path carrier 7.

This is indicated by the symbols for the first rotational direction 29*a* and the second rotational direction 29*b*, independent of the respective rotational speeds (absolute).

Figure 5:
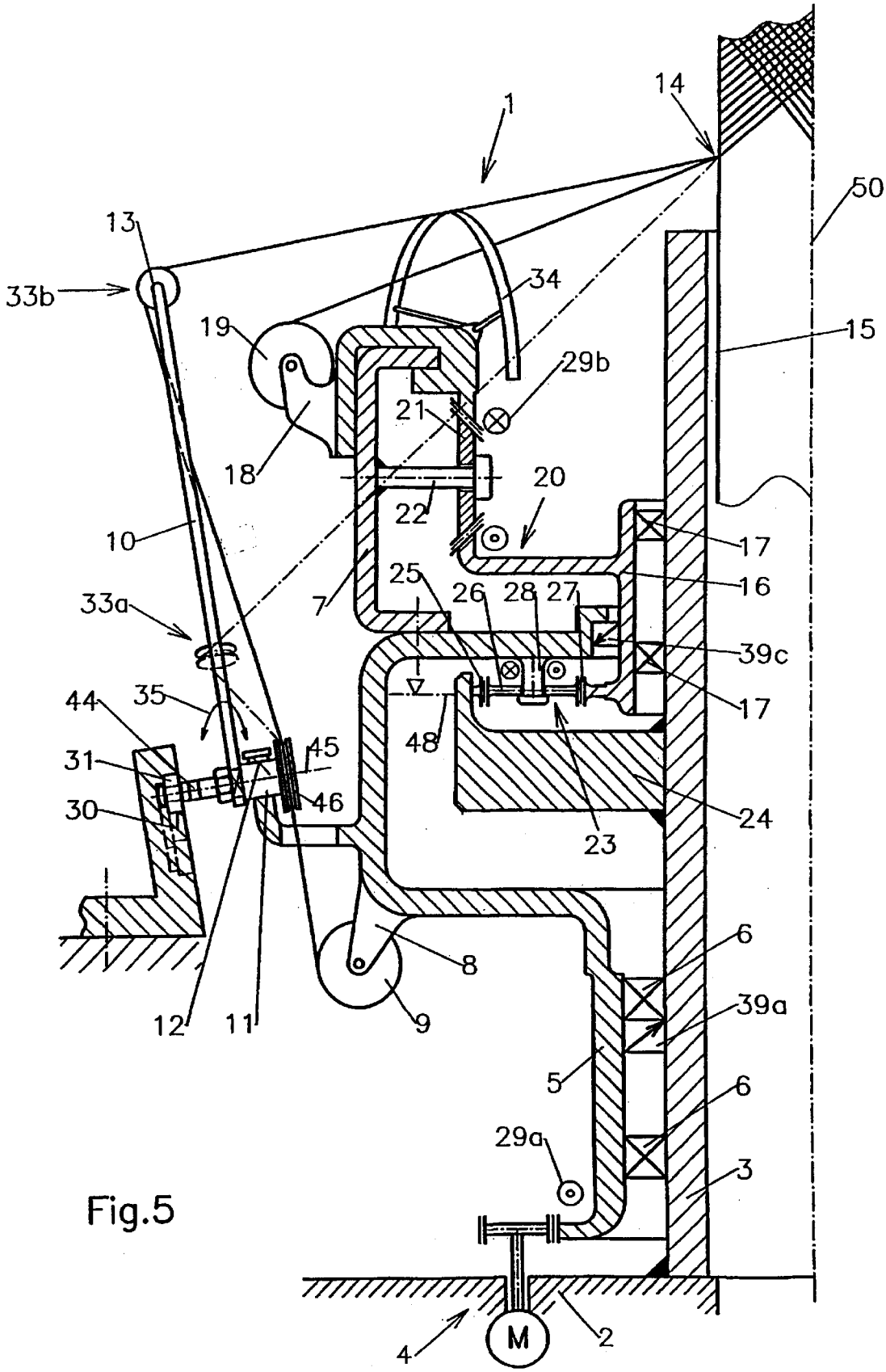
FIG. 5 the reversing gear according to FIG. 4 on a braiding machine with a curved path positioned outside of the rotational plane.

Since the sliding block 31 during this movement in the first rotational direction 29*a* moves in the stationary curved path 30, it is possible to impart onto the thread lever a pivot movement with a corresponding arrangement, for example, as illustrated in FIG. 3 and in FIG. 5.

The pivot movement 35 is carried out between lower pivot positions 33*a* and upper pivot positions 33*b* while the thread lever 10 is rotated about the central axis 50.

As illustrated additionally in FIG. 3, the sliding block 31 is seated on a guide lever 44 which has a spacing from the geometric pivot axis 45 of the pivot axle 11.

Since the pivot axle 11, in turn, is rotatably supported, by means of a correspondingly configured curved path 30 the thread lever 10 can be caused to perform a reciprocating pivot movement while it rotates about the central axis 50.

In the embodiments according to FIGS. 1 through 4, the pivot axle 11 is supported in the gear housing 5.

In principle, this also applies to the support of the pivot axle in the embodiment according to FIG. 5.

However, in this embodiment the pivot axis is not oriented in the direction toward the central pipe 3 but away from it.

Accordingly, the curved path 30 is positioned in an area outside of the rotational plane 32 of the braiding machine and has on the mantle surface facing in the direction toward the central pipe 3 an engagement zone for the sliding block 31 moving in this area.

The curved path 30 is a component of a ring which surrounds the braiding machine and can have a relatively small diameter as a result of the configuration of the reversing gear as compact as possible in the embodiment according to FIG. 5.

Moreover, the compact reversing gear in the embodiment according to FIG. 5 also favors increasing the rotational speed limit of such braiding machines because the sliding pair between the sliding block 31 and the curved path 30 operates with relatively minimal circumferential speeds.

The geometry of the gear housing 5 according to FIG. 5 is not to scale. The actual size of the gear housing 5 is significantly smaller and allows shrinking of the inner diameter of the ring with the curved path 30 correspondingly.

The respective path-time law of the thread lever movement is predetermined by the principal contour of the thread guide 34.

In the embodiments according to FIGS. 1 through 4, it is decisive that the sliding block 31 as well as the curved path 30 are positioned within the rotational plane 32 which is described by the thread lever when carrying out its rotational movement about the central axis 50.

The forces which are introduced onto the thread lever for its control will thus originate from an engagement circle whose radius is smaller than the rotational plane 32 described by the thread lever 10.

In addition, it can be provided that the sliding block 31 and the curved path 30 are positioned within the inner end 36 of the pivot axle 11. In this case, the engagement circle between the sliding block 31 and the curved path 30 is within the circle which is described by the inner end 36 of the pivot axle 11.

Figure 4:
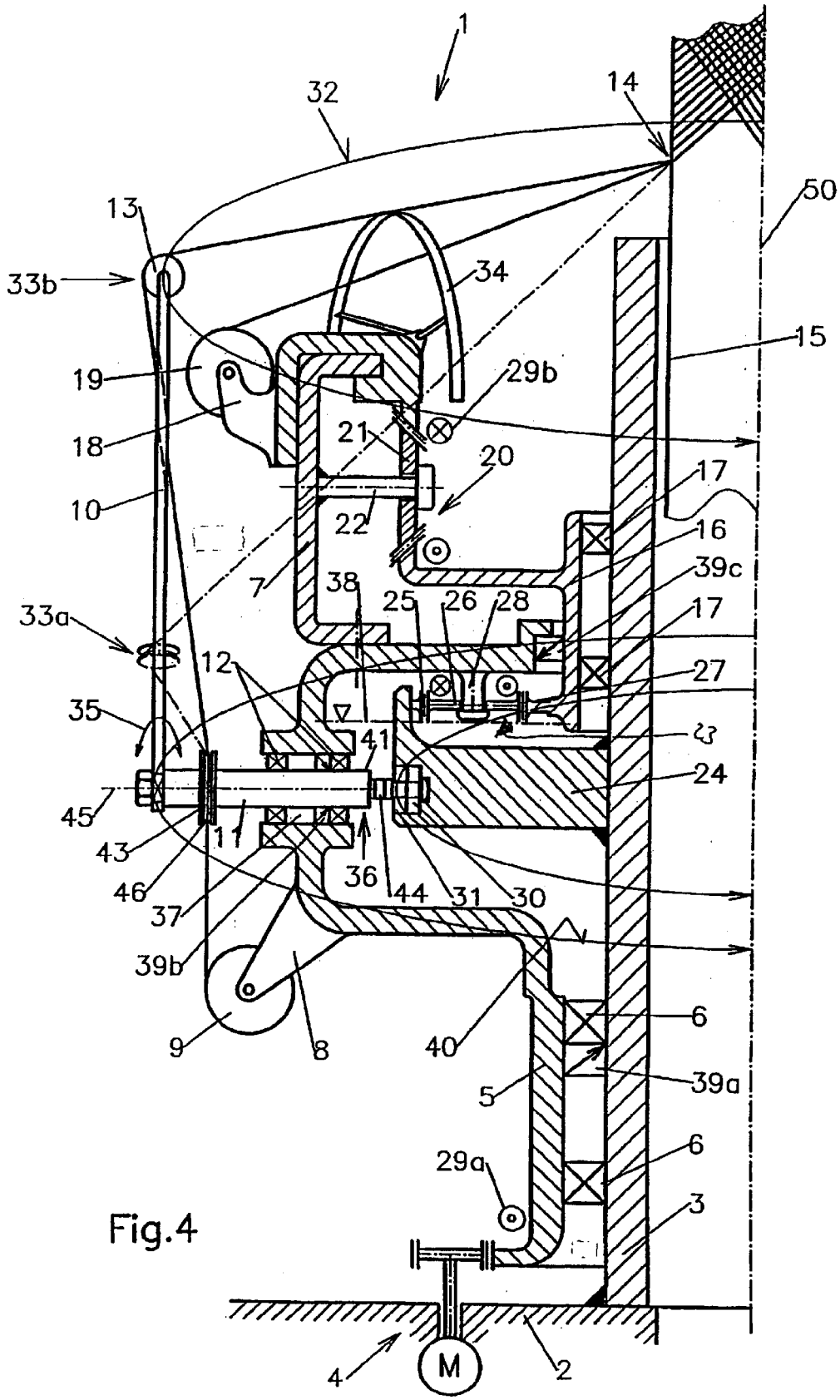
FIG. 4 an embodiment of the invention with a special configuration of the reversing gear.

Moreover, FIGS. 1 and 4 show that the pivot axle 11 is rotatably supported in a bore 37 of the gear housing 5.

When it is moreover provided that the bearing of the gear housing on the central pipe as well as on the outer circumference of the internal ring gear 16 as well as the pivot support of the pivot axle 11 on the gear housing are sealed by radial seals 39*a–c*, the oil level 38 within the gear housing 5 can be realized such that the sliding block 31 and curved path 30 are positioned within the oil bath. The oil-tight gear housing 5 can be optionally provided with a suitable drainage plug.

Since the curved path 30, in turn, is mounted on the annular console 24, it is thus possible to generate a wear-free and environmentally clean permanent lubrication between the sliding block 31 and the curved path 30, in connection with the advantage of significantly higher relative speeds and thus higher rotational speeds for the braiding machine.

In any case, it is however fulfilled that the curved path support, in the illustrated embodiments the outer circumference of the annular console 24, is practically positioned on an extension of the central axis 50 of the annular rotational plane 40 which is defined by the pivot axle 11.

This results in a direct and effective transmission of the course of the curved path 30 onto the thread lever 10 because the force-transmitting members between the sliding block 31 and the pivot axis 11 are short and compact.

Additionally, the pivot axle 11 can be inclined with its end 41 oriented to the central pipe 3 in the direction to the braiding point 14. This measure provides an effective braiding geometry and is known in the art.

In order to provide an effective engagement between the sliding block 31 and the curved path 30, the curved path should be inclined with the same slant angle such that the sliding block engages with a contact surface as large as possible the walls of the curved path 30.

In addition, it is also provided that a thread buffer roll 43 is correlated with the pivot axle 11 of the thread lever 10 and has a weft thread groove 46 concentrically arranged to the pivot axle 11.

This measure provides for compensation of tension changes in the weft thread which can be caused by the pivot movement of the thread lever 10 between lower pivot position 33*a* and upper pivot position 33*b*.

The geometrically optimal course of the curved path 30, and thus the alternating movement of the sliding block 31 during its revolution, is in principle determined by the curved thread triangle which is defined between the braiding point 14 and the deflection device 13 on the thread lever 10 and is positioned above the envelope which is described by the warp threads between their warp thread bobbins 19 and the individual braiding points 14.

Since these laws of movement are however sufficiently known, see, for example, catalog "Spirka-Schnellflechter", no further explanation is provided in this connection.

In the embodiments according to FIGS. 4 and 5, it is also shown that the internal ring gear 25, the revolving pinion 26, and the external ring gear 27 are positioned in one and the same radial plane 48 relative to the central pipe 3 and mesh with one another in this radial plane.

This measure serves for preventing possible bending moments on the bearing of the pinion axle which rotates together with the gear housing and is therefore referred to as revolving axle 28.

Moreover, with one and the same outer toothing on the revolving pinion 26 the entire gear coupling, including the transmission between the drive motor and the internal ring gear 16, is effected.

This is achieved in that the pinion 26 meshes directly with the internal ring gear 25 as well as directly with the external ring gear 27, wherein the intermediate wheel 21 is loaded by the output side of the external ring gear 27 and at the same time engages a gear which is mounted on the upper bobbin carriers 18.

For this purpose, the intermediate wheel is positioned on an intermediate wheel shaft 22 which is connected fixedly with the gear housing 5 and positioned above the radial plane 48 in which the internal ring gear 25, revolving pinion 26, and external ring gear 27 mesh with one another.

List of Reference Numerals 1 braiding machine
2 machine frame
3 central pipe
4 drive
5 gear housing
6 gear housing bearing
7 sliding path carrier
8 lower bobbin carrier
9 weft thread bobbin
10 thread lever
11 pivot axle
12 pivot axle bearing
13 deflection device
14 braiding point
15 elongate article to receive braid
16 internal ring gear
17 internal ring gear bearing
18 warp thread carrier
19 warp thread bobbin
20 reversing gear
21 intermediate wheel
22 intermediate wheel shaft
23 transmission stage
24 annular console
25 internal ring gear
26 revolving pinion
27 external ring gear
28 revolving axle
29*a* first rotational direction
29*b* second rotational direction
30 curved path
31 sliding block
32 rotational plane
33*a* lower pivot position
33 be upper pivot position
34 thread guide
35 pivot movement
36 inner end of pivot axle
37 bore of the gear housing
38 oil level

39*a, b, c* radial seal
40 rotational plane of the pivot axle
41 end of the pivot axle pointing to the central pipe
42 slant angle
43 thread buffer roll
44 guide lever
45 geometric pivot axis
46 weft thread groove
48 radial plane
50 central axis

What is claimed is:

1. A device for controlling the thread lever (10) of a braiding machine (1), the device comprising:

a circular ring-shaped, closed curved path (30) and a correlated sliding block (31) engaging the curved path (30), wherein the sliding block (31) is arranged within a gear housing (5) of the braiding machine;

wherein the thread lever (10) has a pivot axle (11) supported above lower feed bobbins of the braiding machine in a bore (37) of the gear housing (5);

wherein the gear housing (5) is driven in rotation in a first rotational direction (29*a*) about a central pipe (3) of the braiding machine;

wherein the thread lever (10) describes as a result of the rotation of the gear housing (5) a rotational plane (32) and is subjected by the sliding block (31) to an oscillating pivot movement (33*a*, 33*b*) about the pivot axle (11) within the rotational plane (32);

a reversing gear (20) comprising an intermediate wheel (21) and connected to the gear housing (5) and to upper bobbin carriers (18) of the braiding machine, wherein the reversing gear (20) transforms the rotation of the gear housing (5) in the first rotational direction into a rotation, imparted onto the upper bobbin carriers (18), in a second rotational direction (29*b*) opposite to the first rotational direction (29*a*);

wherein the sliding block (31) and the curved path (30) are located within the rotational plane (32);

wherein the gear housing (5) contains an oil bath and wherein the gear housing (5) and the bore (37) of the gear housing (5) are sealed oil-tightly; and wherein the sliding block (11) and the curved path (30) are located within the oil bath of the gear housing (5).

2. The device according to claim 1, comprising a curved path carrier in the form of an annular console (24) fixedly connected to the central pipe (3), wherein the curved path (30) is arranged on the annular console (24).

3. The device according to claim 2, wherein the annular console (24) is positioned within the gear housing (5).

4. The device according to claim 3, wherein the curved path carrier is arranged on an extension of a central axis (50) of a rotational plane (40) described by the pivot axle (11).

5. The device according to claim 1, wherein the pivot axle (11) has an end (41) pointing to the central pipe (3) and wherein the end of the pivot axle (11) is inclined at a slant angle (42) toward a braiding point (14).

6. The device according to claim 5, wherein the slant angle (42) relative to a radial direction of the central pipe (3) is not greater than 45 degrees.

7. The device according to claim 5, wherein the curved path (30) is slanted about the same slant angle (42) as the pivot axle (11).

8. The device according to claim 1, further comprising a thread buffer roll (43) connected to the pivot axle (11).

9. The device according to claim 8, wherein the thread buffer roll (43) has a weft thread groove (46) concentric to the pivot axle (11).

10. A braiding machine (1) comprising:

a central pipe (3) and a gear housing (5) rotatingly driven about the central pipe (3) in a first rotational direction (29*a*);

lower bobbin carriers (8) for lower feed bobbins (9) connected to the gear housing (5);

upper bobbin carriers (18) for upper feed bobbins (19) rotatably supported so as to rotate about the central pipe (3);

a positive-locking reversing gear (20) with intermediate wheel (21) connected between the lower bobbin carriers and the upper bobbin carriers;

wherein the reversing gear (20) has an input side and an output side, wherein the input side is loaded by the rotation of the gear housing in the first rotational direction (29*a*) and the output side generates a rotation in a second rotational direction (29*b*) opposite to the first rotational direction (29*a*) acting on the upper bobbin carriers (18);

wherein the reversing gear (20) comprises an internal ring gear (25) stationarily arranged on the central pipe (3) and having a first reference diameter, a pinion (26) revolving in the internal ring gear (25), and an external ring gear (27) having a second reference diameter smaller than the first reference diameter and rotatably supported on the central pipe (3);

a revolving axle (28) fixedly connected to the gear housing (5);

wherein the revolving pinion (26) is rotatably supported on the revolving axle (28) and positive-lockingly connects the internal ring gear (25) and the external ring gear (27).

11. The braiding machine according to claim 10, wherein the internal ring gear (25), the revolving pinion (26), and the external ring gear (27) mesh with one another in a common radial plane (48) of the central pipe (3).

12. The braiding machine according to claim 10, wherein the revolving pinion (26) meshes directly with the internal ring gear (25) and directly with the external ring gear (27) and wherein the intermediate wheel (21) is loaded by the output side of the external ring gear (27) and is supported on an axle (22) which is connected fixedly to the gear housing (5) and engages a ring gear on which the upper bobbin carriers (18) are seated.

13. The braiding machine according to claim 10, wherein a rotational speed ratio of a rotational speed of the external ring gear (27) to a rotational speed of the gear housing (5) is 3:1.

* * * * *